US007326073B2

(12) United States Patent
Hanning et al.

(10) Patent No.: US 7,326,073 B2
(45) Date of Patent: Feb. 5, 2008

(54) ADAPTER HOUSING FOR CONNECTING INSERT DEVICES TO A CABLE FITTING

(75) Inventors: Claudia Hanning, Detmold (DE); Juergen Ziemke, Detmold (DE); Michael Hoeing, Lemgo (DE); Michael Schnatwinkel, Herford (DE); Michaela Muecke, Detmold (DE); Simon Seereiner, Bielefeld (DE); Christian Neese, Bielefeld (DE); Thomas Tappe, Detmold (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/641,433

(22) Filed: Dec. 19, 2006

(65) Prior Publication Data

US 2007/0249218 A1 Oct. 25, 2007

(30) Foreign Application Priority Data

Apr. 22, 2006 (DE) ..... 20 2006 006 607 U
May 29, 2006 (DE) ..... 20 2006 008 602 U
Jun. 12, 2006 (DE) ..... 20 2006 009 187 U

(51) Int. Cl.
*H01R 13/625* (2006.01)

(52) U.S. Cl. ..... 439/344

(58) Field of Classification Search ..... 439/352, 439/357, 344, 660, 668
See application file for complete search history.

(56) References Cited

U.S. PATENT DOCUMENTS 2,546,201 A * 3/1951 Lucien ..... 439/270
4,349,236 A 9/1982 Guelden
4,641,906 A * 2/1987 Olsson ..... 439/465
5,234,357 A * 8/1993 Yamaguchi ..... 439/354
6,196,874 B1 * 3/2001 Wu ..... 439/607
6,402,554 B1 * 6/2002 Yeh ..... 439/607
6,475,009 B2 11/2002 Below
6,503,108 B1 * 1/2003 Kikuchi et al. ..... 439/358
6,595,791 B2 7/2003 Below
6,764,338 B2 * 7/2004 Fang ..... 439/607

* cited by examiner

*Primary Examiner*—Briggitte R. Hammond
(74) *Attorney, Agent, or Firm*—Lawrence E. Laubscher, Sr.; Lawrence E. Laubscher, Jr.

(57) ABSTRACT

A locking device attaches to a first end of a plug-supporting housing a telecommunications plug having a cable that extends through a longitudinal bore contained in the housing. The locking device includes at least one locking plate having a first end portion connected with the housing, and a second end portion containing a projection for engaging a corresponding retaining surface, thereby to retrain the plug within a first plug-receiving chamber contained within a first end of the housing. In a first embodiment, the locking plate directly retains in the first chamber either the plug, or a hollow adapter frame that contains the plug. In a second embodiment, an adapter body containing a second plug-receiving chamber is fastened to the housing first end, and a pair of locking plates lock within the second chamber either the plug, or an adapter frame that contains the plug.

19 Claims, 19 Drawing Sheets

Fig. 11a
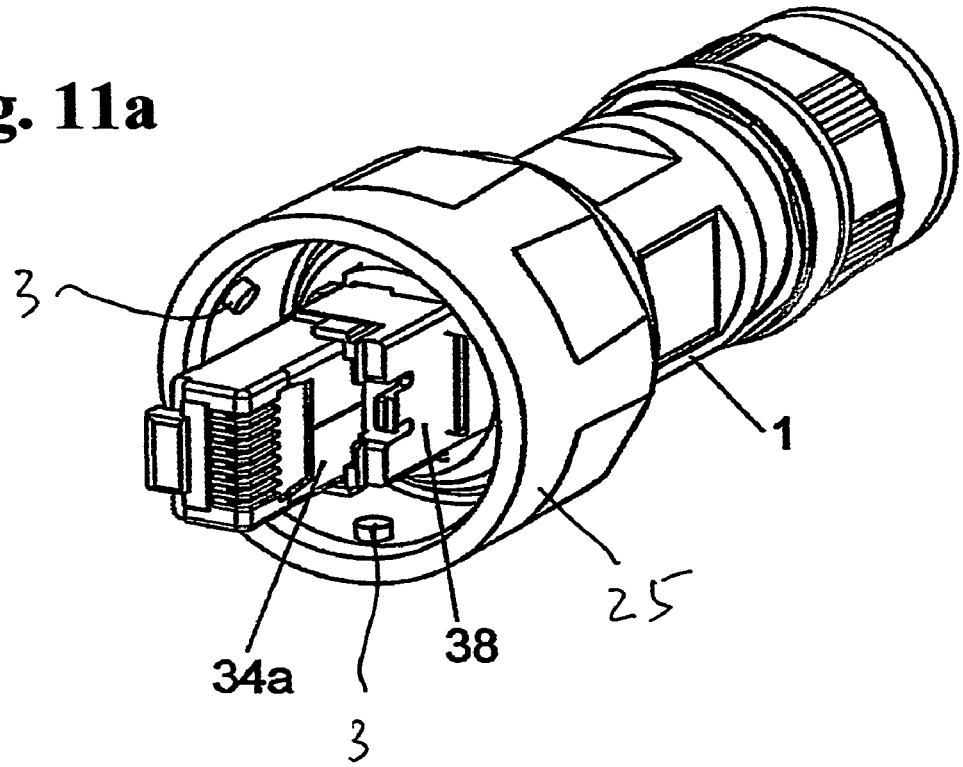
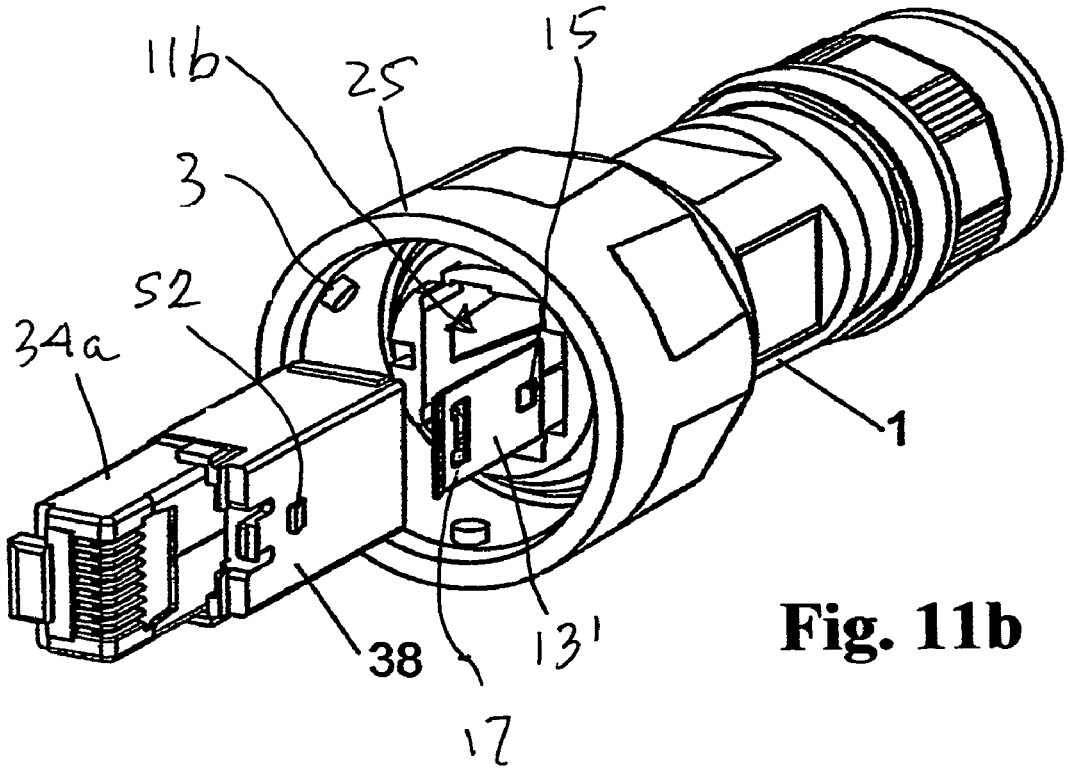
Fig. 11b

Fig. 12a
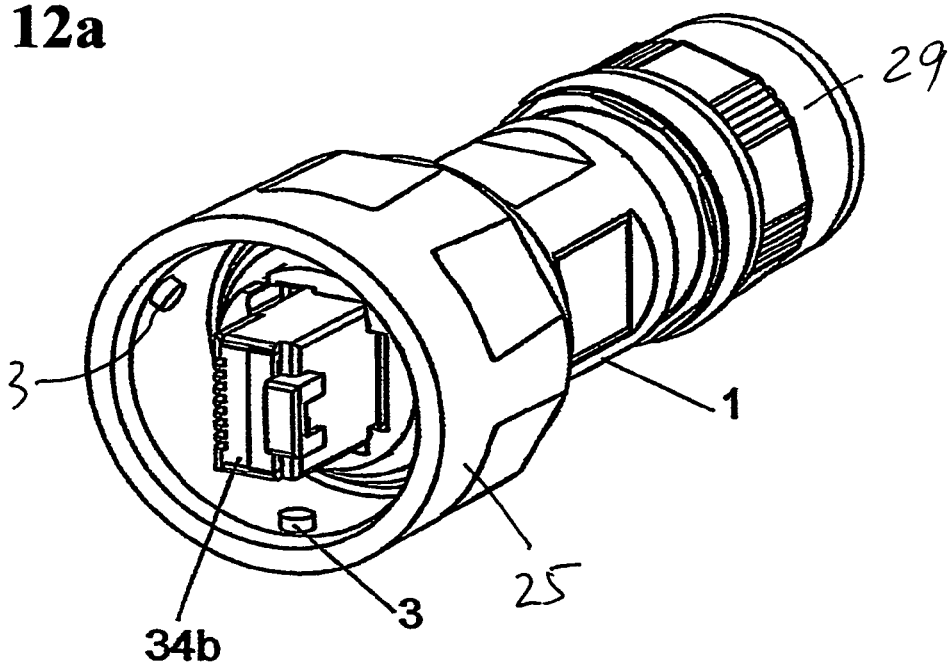
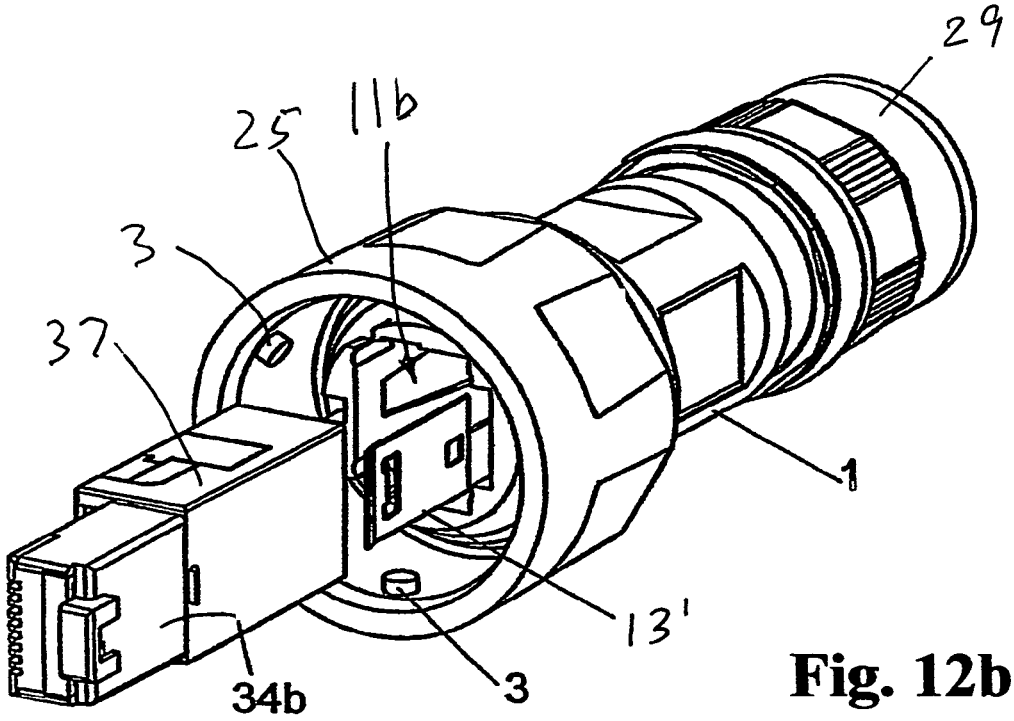
Fig. 12b

Fig. 13a
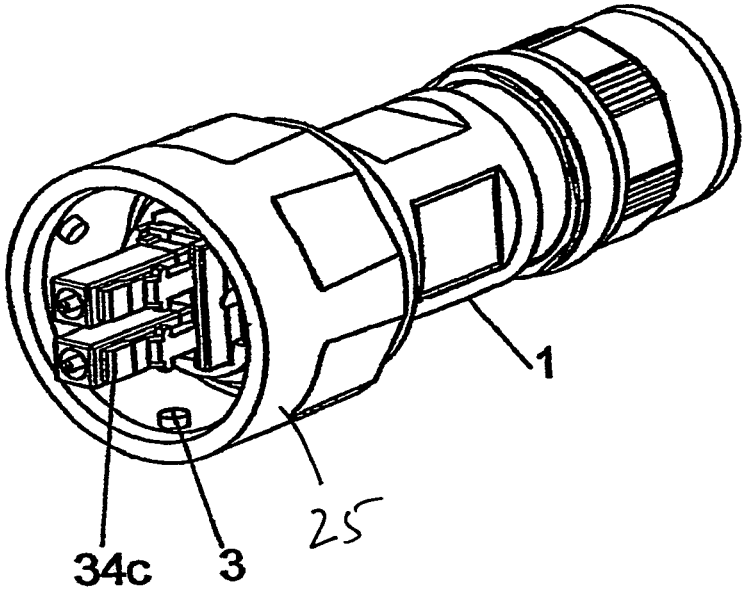
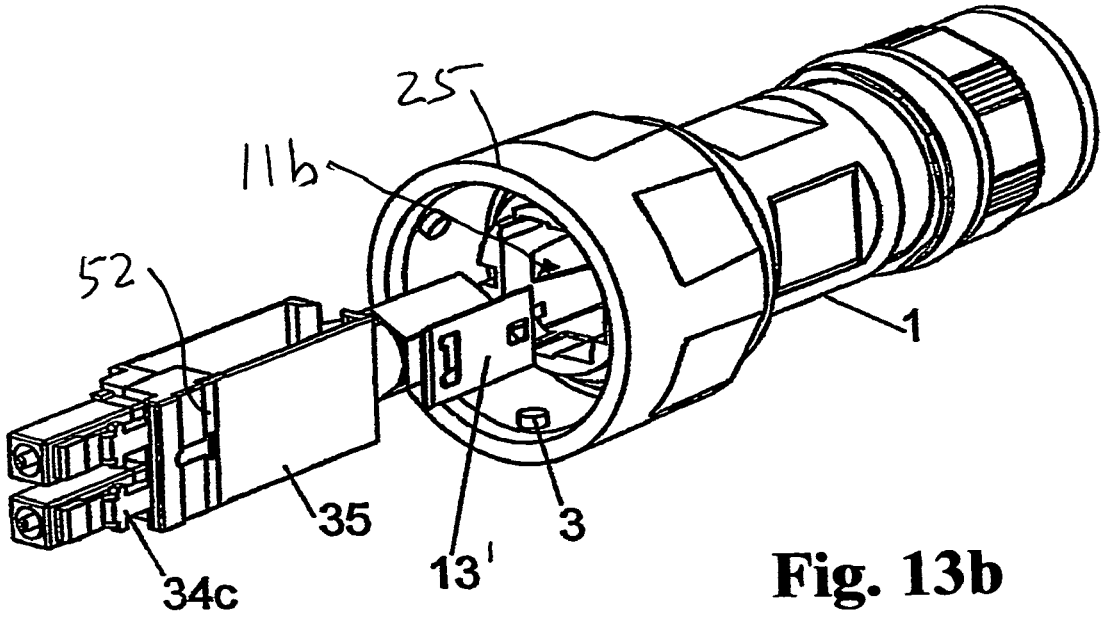
Fig. 13b

Fig. 14a
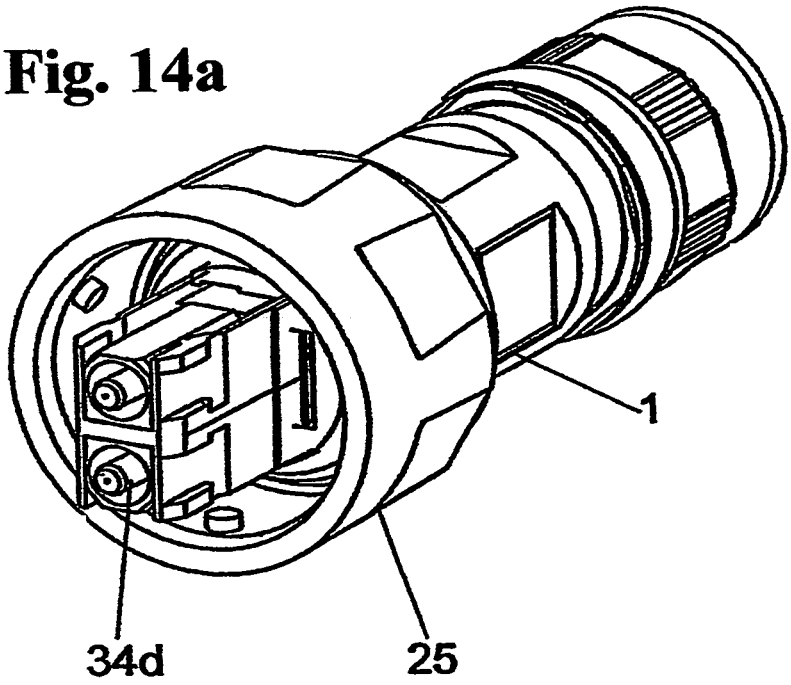
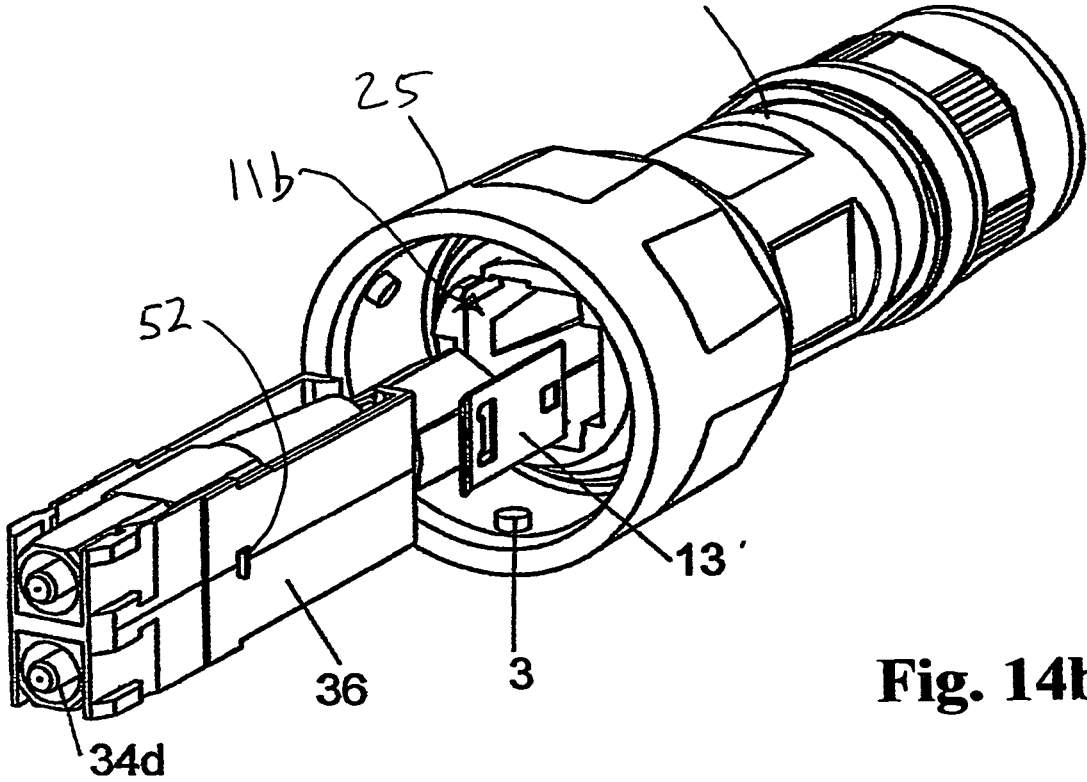
Fig. 14b

Fig. 16a
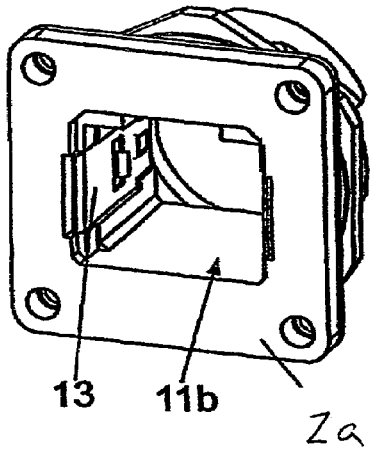
Fig. 16b
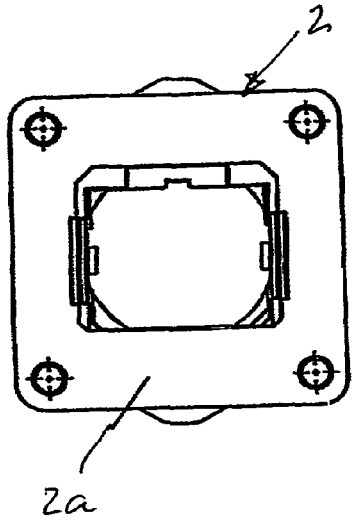
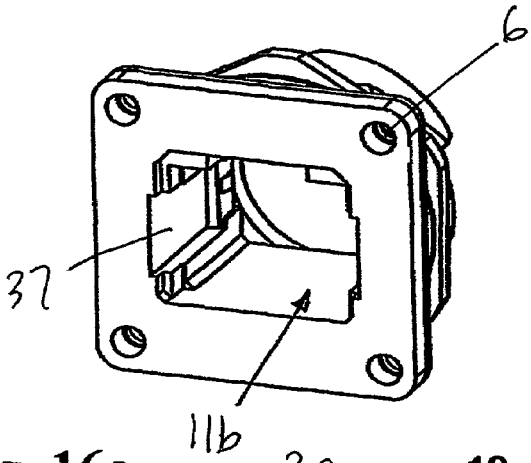
Fig. 16c
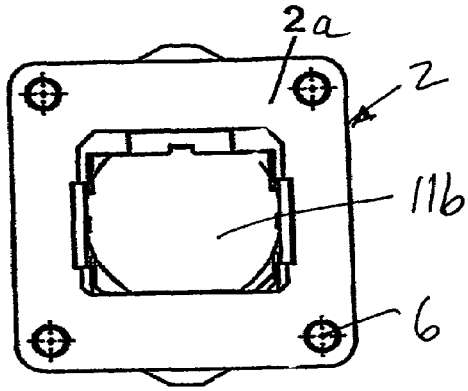
Fig. 16d
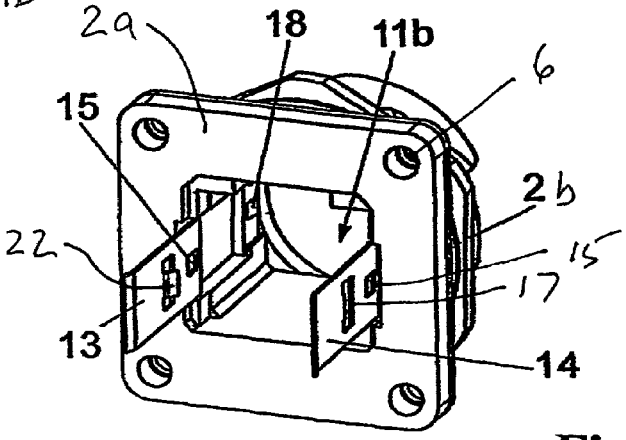
Fig. 16e

ADAPTER HOUSING FOR CONNECTING INSERT DEVICES TO A CABLE FITTING

CROSS REFERENCE TO RELATED APPLICATIONS

This application is a companion application to the Muhs et al application Ser. No. 11/593,417 filed Nov. 6, 2006 entitled "Adapter for Attaching an Insertion Device to a Cable Fitting".

BACKGROUND OF THE INVENTION

1. Field of the Invention

A locking device attaches to a first end of a plug-supporting housing a telecommunications plug having a cable that extends through a longitudinal bore contained in the housing. The locking device includes at least one locking plate having a first end portion connected with the housing, and a second end portion containing a projection for engaging a corresponding retaining surface, thereby to retrain the plug within a first plug-receiving chamber contained within a first end of the housing. In a first embodiment, the locking plate retains in the first chamber either the plug, or a hollow adapter frame that contains the plug. In a second embodiment, an adapter body containing a second plug-receiving chamber is fastened to the housing first end, and a pair of locking plates lock within the second chamber either the plug, or an adapter frame that contains the plug.

2. Description of the Related Art

It is known in the patented prior art to provide fittings for supporting the plugs and cables of a telecommunications system, as shown by the U.S. patent to Guelden No. 4,349,236. Typical adapter housings make it possible to use the plug and socket parts inserted in them also in a rougher environment—for example, in production facilities or vehicles—by attaining a protection class that will be higher when compared to the protection class of the plug part such as, for example, IP65 or IP67. The idea of meeting stiffer requirements from environmental classifications was further developed and anchored, for example, in the typical systems shown in the U.S. patents to Below et al Nos. 6,475,009 and 6,595,791. These patents disclose various adapter plug housings and adapter jacket housings, which in each case are suitable for receiving RJ45 plugs or RJ45 sockets.

The present invention was developed to provide a more developed embodiment of an adapter plug housing and an adapter socket housing where the design of the locking arrangement of the plug part and the socket part on the adapter plug housing and on the adapter socket housing is optimized.

Preferably, the adapter housing should furthermore meet stiff mechanical and chemical stresses and requirements with simple design means, and it should nevertheless be suitable for receiving plug parts and socket parts that vary in type or size.

BRIEF SUMMARY OF THE INVENTION

Accordingly, a primary object of the present invention is to provide locking means for locking in a first chamber contained in the first end of an elongated housing a telecommunications plug having a cable that extends through a longitudinal bore contained in the housing, said locking means including at least one rectangular resilient locking plate having a first end connected with the housing, and a second end connected with the telecommunications plug.

According to a more specific object of the invention, in a first embodiment, the locking plate locks the plug directly to one wall of the first chamber. In a second embodiment, two parallel spaced locking plates lock between a pair of opposing walls of the first chamber a hollow adapter frame containing the plug. In a third embodiment, an adapter body is attached to the first end of the housing, said adapter body containing a second through bore the communicates with the first through bore of the housing and with a second chamber within which is fastened by the locking plates either the plug or a hollow adapter frame containing the plug.

A further object of the invention is to provide a telecommunications plug locking arrangement including at least one resilient rectangular plug formed from metal or a synthetic plastic material, said plate having a first end containing an opening for receiving a fixed projection on the housing, and a second end including a projection for engaging a stop or retaining surface fixed with respect to the plug. Preferably the pug is cantilevered with the free extremity thereof be inclined outwardly at an acute angle to facilitate the insertion of the plug into its associated chamber. The locking plates maintain the components together in a positive manner during rough usage of the cable fitting assembly.

BRIEF DESCRIPTION OF THE DRAWINGS

Other objects and advantages of the invention will become more apparent from a study of the following specification, when viewed in the light of the accompanying drawings, in which:

FIGS. 11*a* and 11*b* are perspective and partially-exploded views, respectively, of the apparatus of FIG. 8*a* including a first telecommunications plug and adapter frame arrangement, and FIGS. 12*a* and 12*b*, FIGS. 13*a* and 13*b*, and 14*a* and 14*b* are corresponding views of other plug and adapter frame arrangements, respectively;

FIGS. 16*a*-16*e* are perspective and end views of a modification of the adapter body arrangement of FIG. 4;

DETAILED DESCRIPTION OF THE INVENTION

Figure 1A:
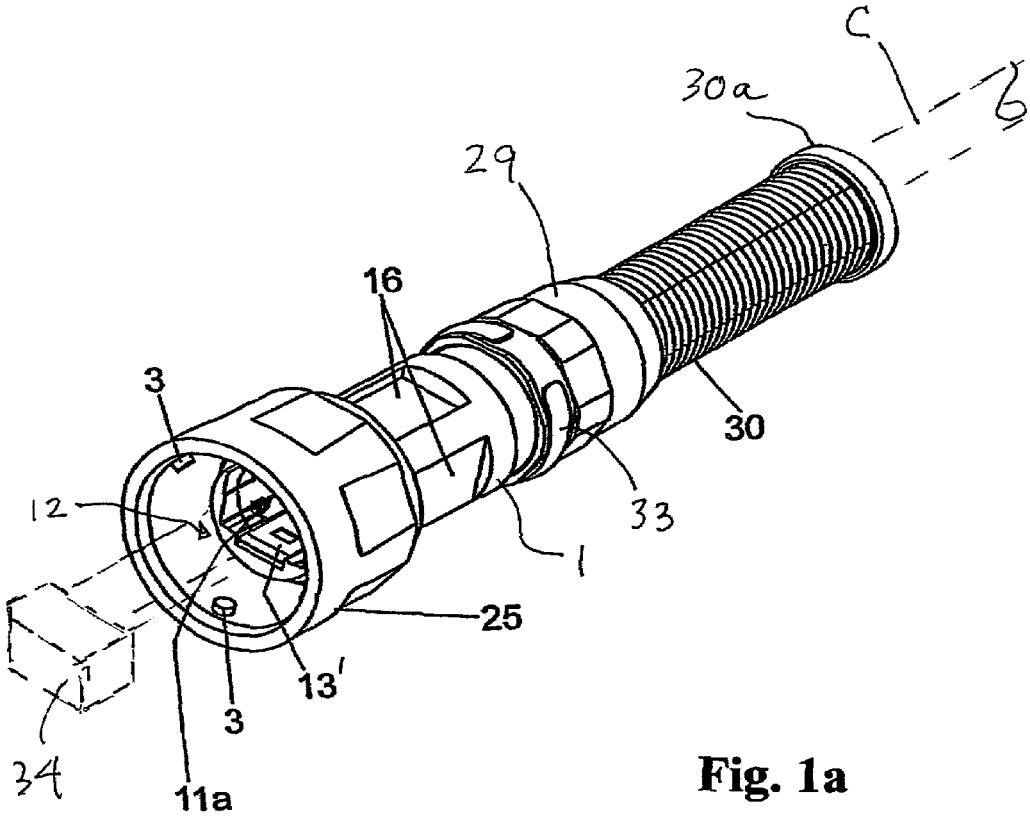
FIGS. 1*a* and 1*b* are perspective and longitudinal sectional views, respectively, of a telecommunications plug and cable fitting arrangement incorporating a first embodiment of the locking means of the present invention.
Figure 1B:
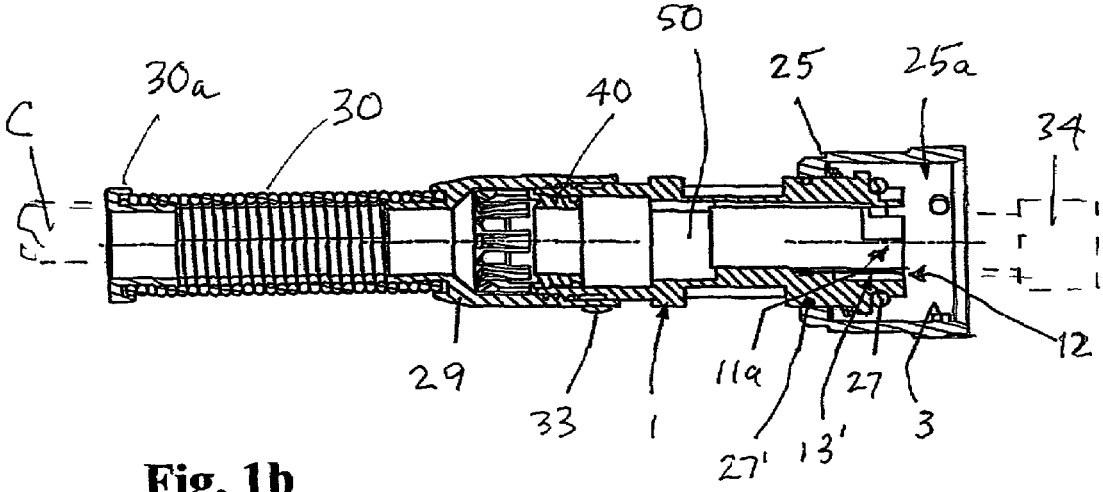
Figure 10:
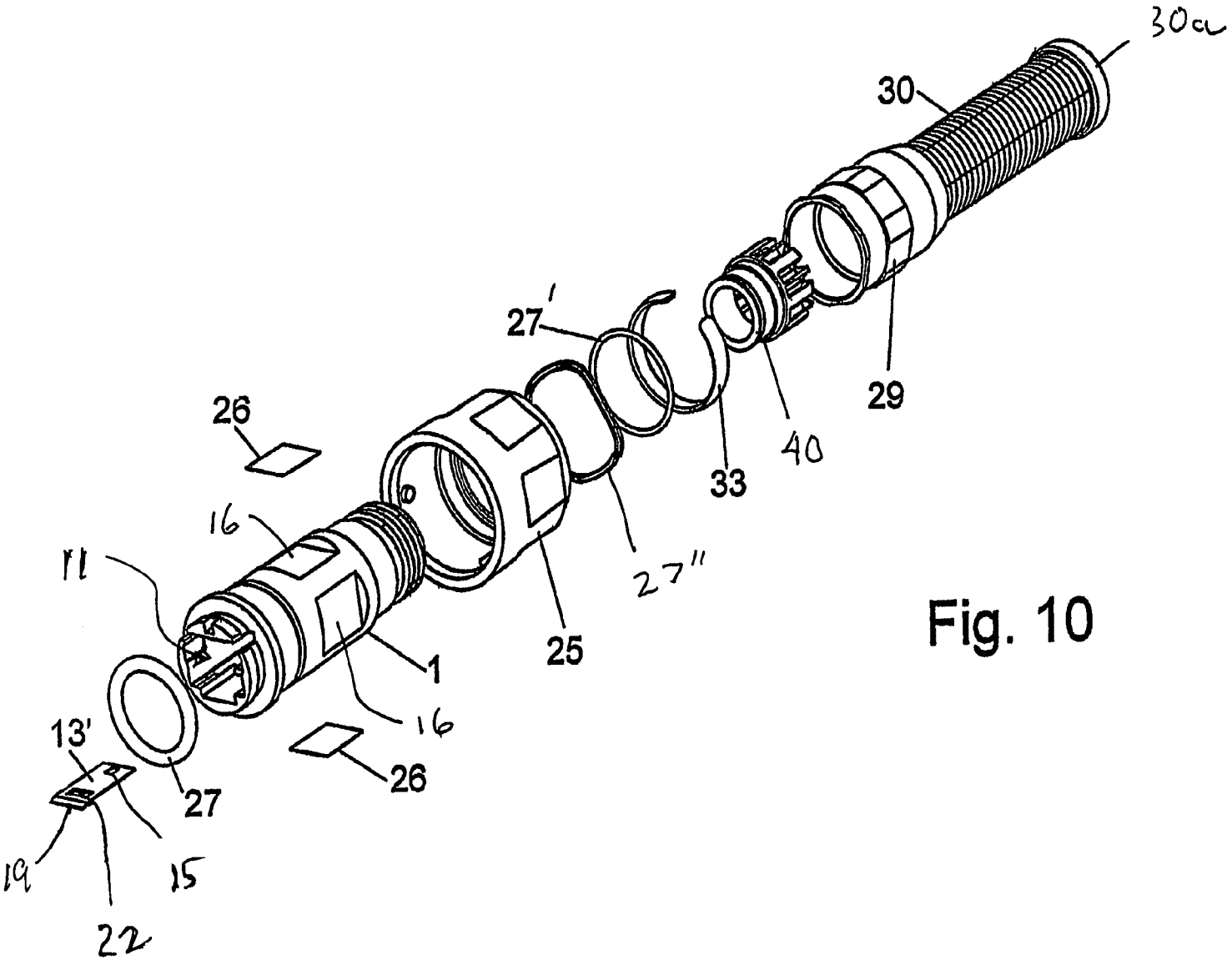
FIG. 10 is an exploded view of the apparatus of FIG. 1*a;*

Referring first more particularly to FIGS. 1*a*, 1*b*, and FIG. 10, the present invention relates to means for connecting to a cable fitting a telecommunications plug 34 having a cable C attached thereto. The cable fitting includes a tubular plug-supporting housing 1 containing a through bore 50 through which the cable C extends. The telecommunications plug 34 is fastened within a first plug-receiving chamber 11*a* contained in a first end of the housing 1. At its other end, the housing is connected by an outer concentrically mounted sleeve 29 with a tubular flexible cable protective member 30 having an annular end cap 30*a*. An internal cable-supporting member 40 having a plurality of spring fingers arranged in circumferentially spaced relation around the cable is mounted within the longitudinal through bore 50, as is known in the art. As shown in FIG. 10, annular seal means 27, 27', and 27" are provided for sealing the concentric spaces defined around the outer surfaces of the housing 1.

As shown in FIG. 10, the housing 1 contains on its outer periphery a plurality of circumferentially spaced recesses 16 that receive labels 26 that are color-coded or that bear indicia relating to the plug 34. Similarly, a color-coded or indicia bearing split outer ring 33 is provided that is either color coded or provided with indicia for identifying the specific plug 34 that is connected with the cable fitting.

Figure 9A:
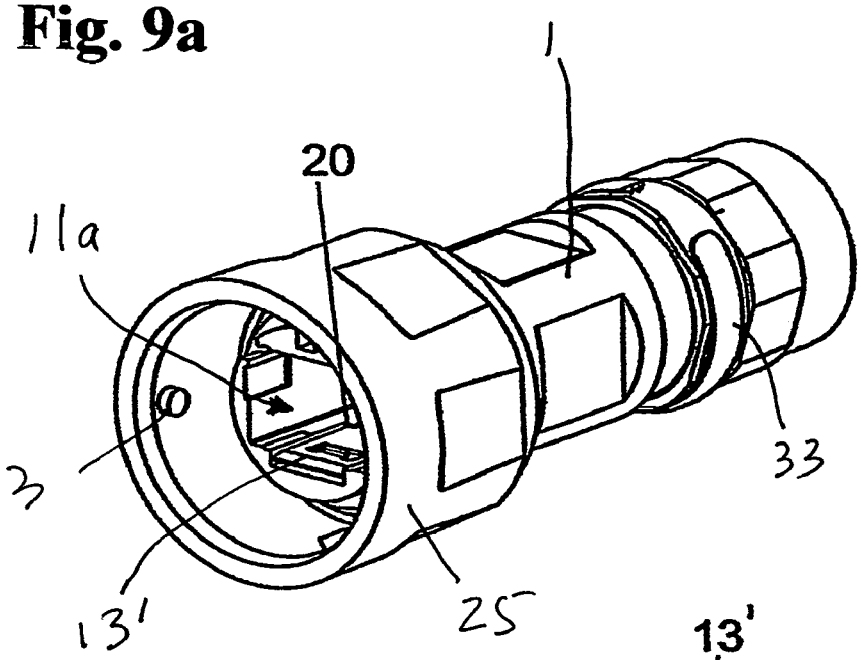
FIGS. 9*a*, 9*b*, and 9*c* are perspective, longitudinal sectional and detailed views, respectively, of the apparatus of FIG. 1*a*, with certain parts removed.
Figure 9B:
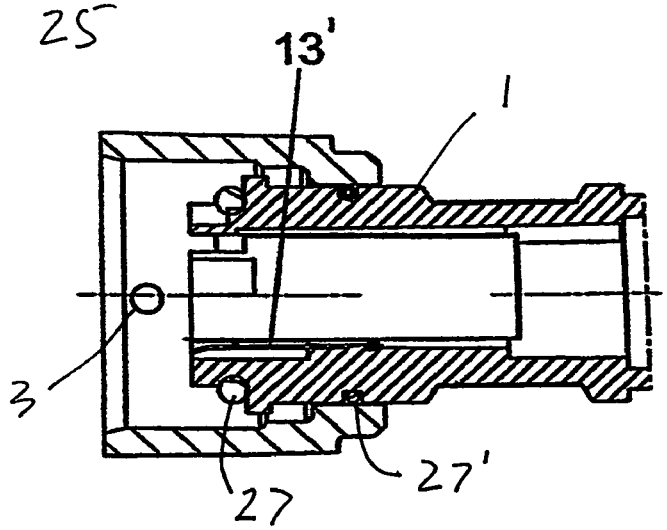
Figure 9C:
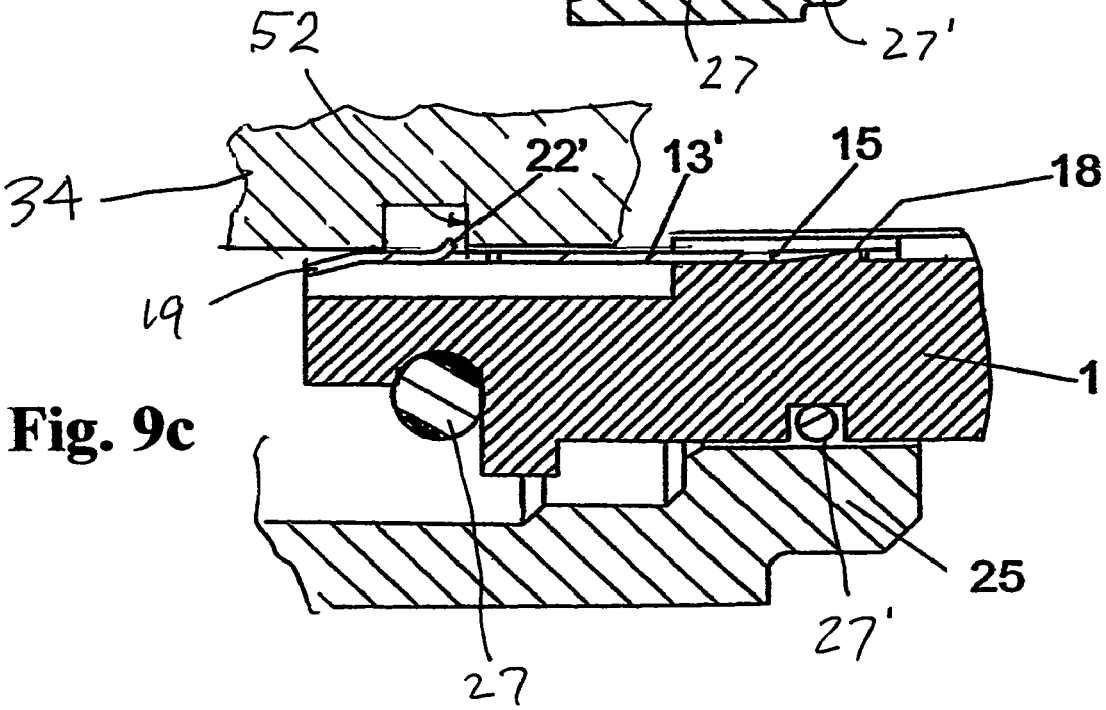

In accordance with a characterizing feature of the invention, the telecommunications plug 34 is locked within the first chamber 11*a* by locking means 12 including a locking plate 13.' As shown in FIGS. 9*a*, 9*b*, 9*c*, and FIG. 10, the locking plate 13' has a generally rectangular configuration and is provided at one end with an opening 15 that receives a fixed internal locking projection 18 on the housing 1, as best shown in FIG. 9*c*. At its other end, the locking plate 13' is provided with an opening 17 that is punched outwardly to define a projection 22' that is adapted to engage a corresponding stop surface 52 on the outer surface of the telecommunications plug 34. The locking plate 13' is formed of a resilient metal or synthetic plastic material, and is provided at its free extremity with an angularly bent portion 19 that is arranged at an acute angle relative to the plane of the locking plate. This angular end portion 19 serves to facilitate entry of the plug into the chamber 11*a* until the projection 22' engages the stop surface 52 on the plug 34.

As shown in FIGS. 8*a*-8*e*, at least one wall of the first chamber 11*a* is provided with a slot 20 or 37 for receiving the locking plate 13.' The walls of the slot 20 are preferably undercut to provide retaining means for retaining the locking plate in place.

Figure 2A:
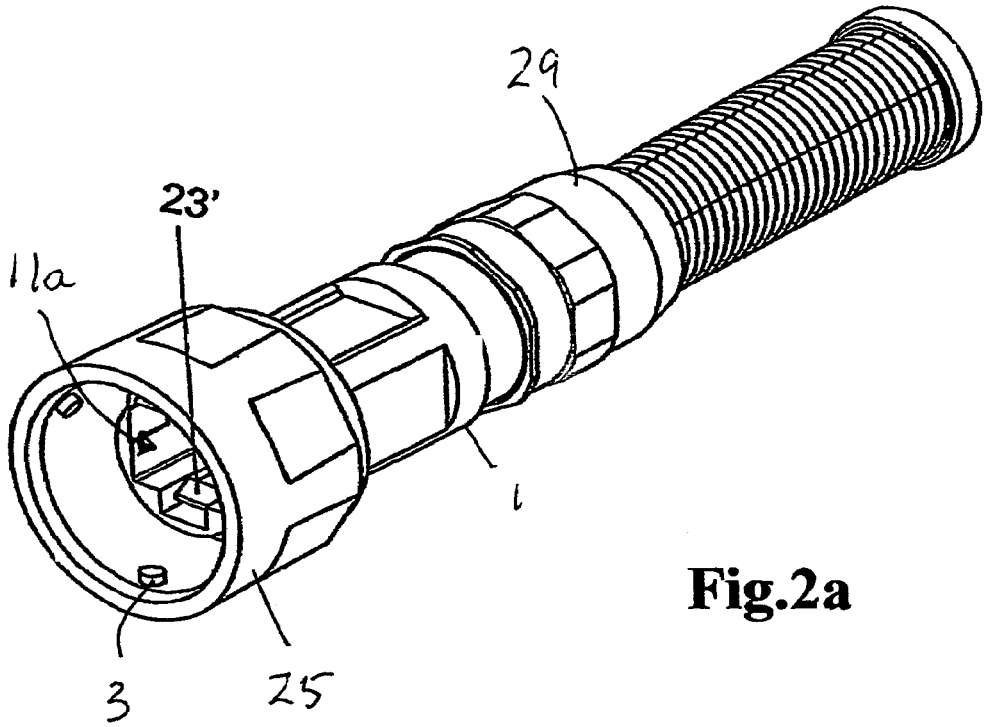
FIGS. 2*a* and 2*b* are perspective and longitudinal sectional views, respectively, of a cable fitting arrangement including a second embodiment of the locking means of the invention.
Figure 2B:
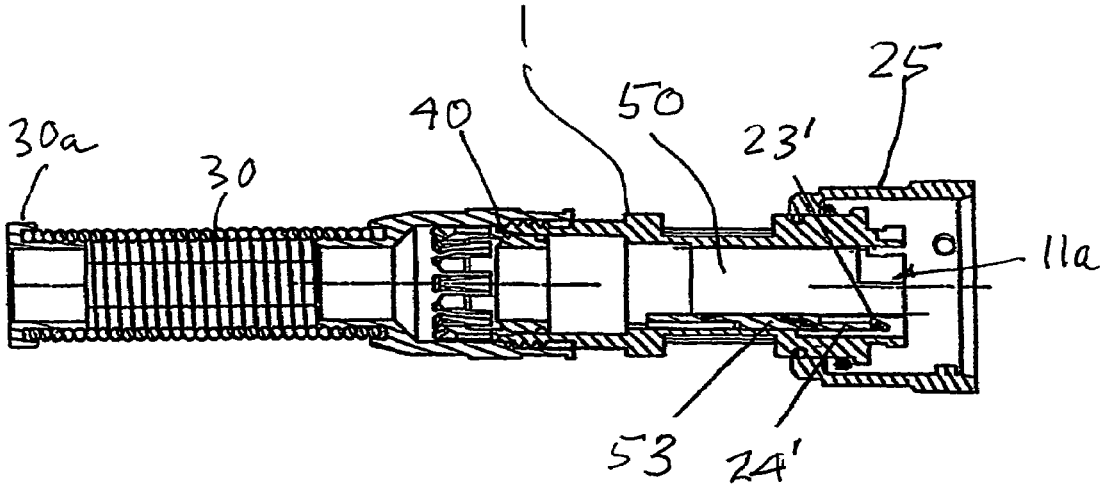
Figure 20A:
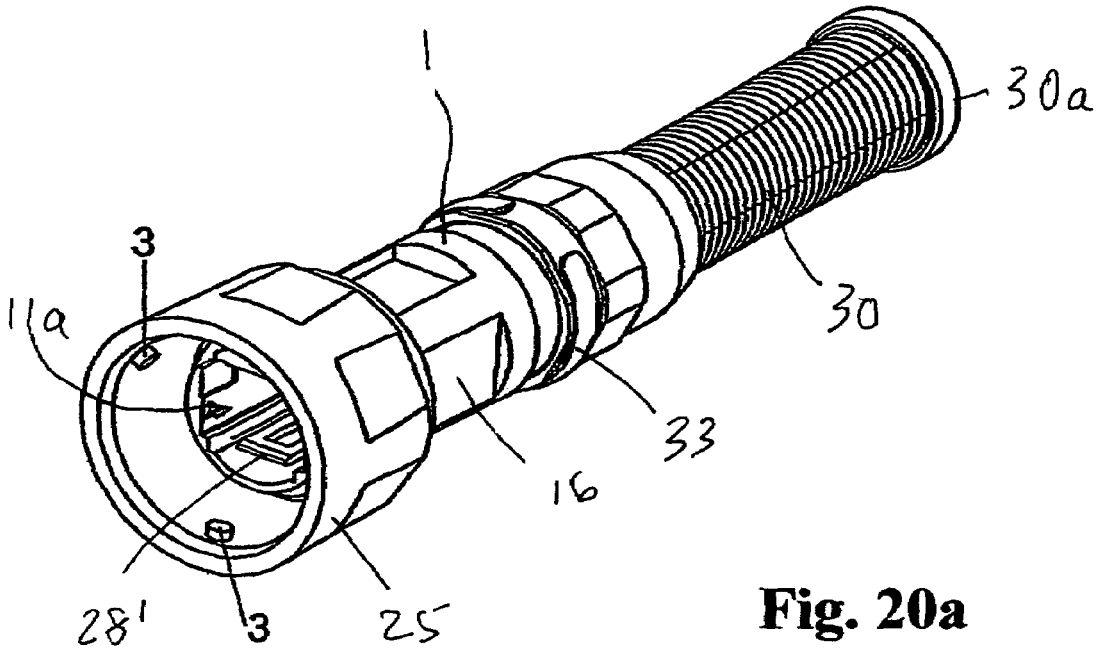
FIGS. 20*a* and 20*b* are perspective and longitudinal sectional views, respectively, of a third modification of the apparatus of FIGS. 1*a* and 1*b*.
Figure 20B:
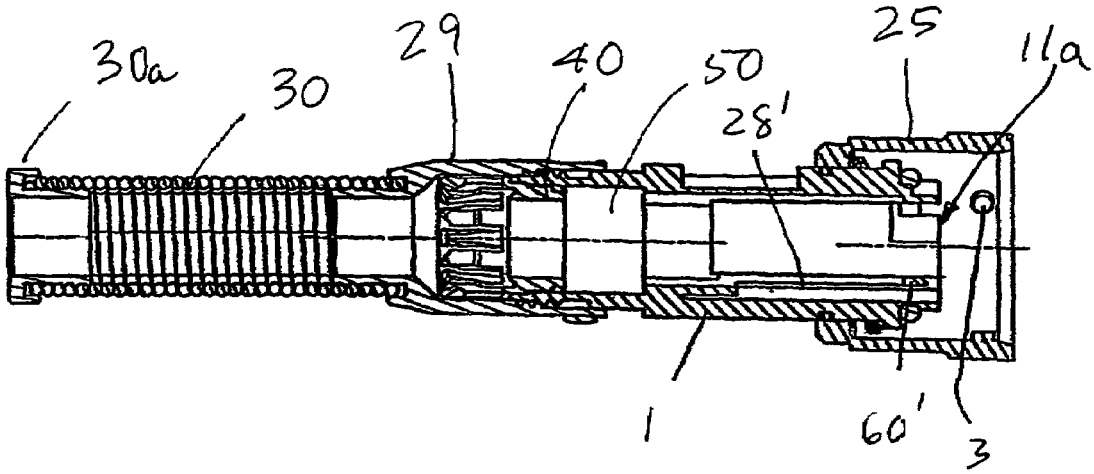

Referring to the modification shown in FIGS. 2*a* and 2*b*, the locking means 12 may be a cantilevered resilient synthetic plastic plate-like member 24' that is provided at its free end with a projection 23' which engages a corresponding stop surface on the telecommunications plug, thereby to retain the same within the first chamber 11*a*. The synthetic plastic locking plate 24' is connected at one end with, and is carried by, a sleeve member 53 that is supported within the bore 50 of the housing 1. In the embodiment shown in FIGS. 20*a* and 20*b*, the locking plate 28' is formed of metal and is integral with the metallic housing 1. In this case, the projection 60' is carried by the free end of the resilient locking plate 28.'

Referring now to FIGS. 11*a* and 11*b*, it will be seen that in order to mount a telecommunications plug 34*a* of a given smaller size within the plug-receiving chamber 11*a*, use is made of an adapter frame 38 as set forth in the prior Muhs U.S. patent application referred to above. In this case, the locking plate 13' is mounted within the first chamber 11*a* by means of a projection (not shown) that cooperates with the opening 15 contained in the locking plate 13.' The projection defined by the opening 17 is operable to engage the stop surface 52 on the outer surface of the adapter frame 38, thereby to retain the adapter frame within the through bore contained in the housing 1. In this embodiment, the plug 34*a* is of the RJ45 telecommunications plug type, as is known in the art.

Referring now to FIGS. 12*a* and 12*b*, a telecommunications plug 34*b* of the RJ45-type is supported by frame 37 within the opening 11*a*, use being made of the locking plate 13' to lock the frame 37 within the housing 1. In the embodiment of FIGS. 13*a* and 13*b*, the locking plate 13' is operable to lock the frame 35 within the first chamber 11*a*, which frame receives an LC-duplex-type connector 34*c*. In the embodiment of FIGS. 14*a* and 14*b*, the locking plate 13' engages the stop opening 52 in the outer surface of the frame 36, thereby to fasten a 2SC spaced from an SC-RJ connector 34*d*.

Figure 3A:
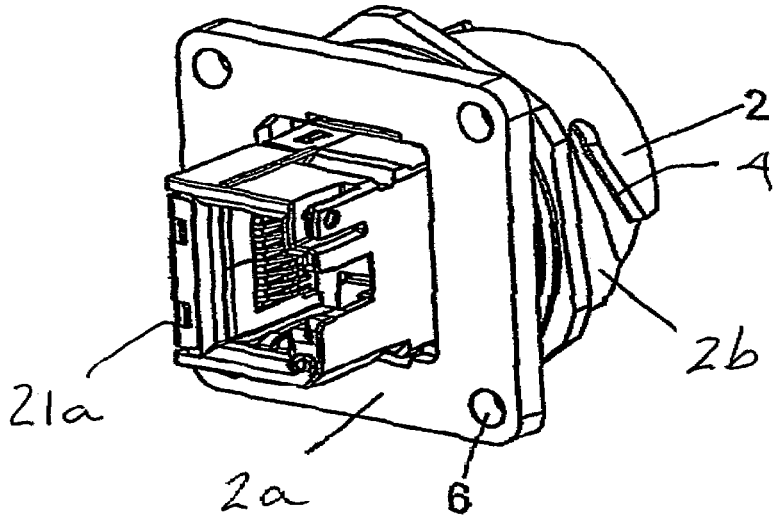
FIGS. 3*a* and 3*b* are perspective and exploded views, respectively, of an adapter body including the locking means of the present invention.
Figure 3B:
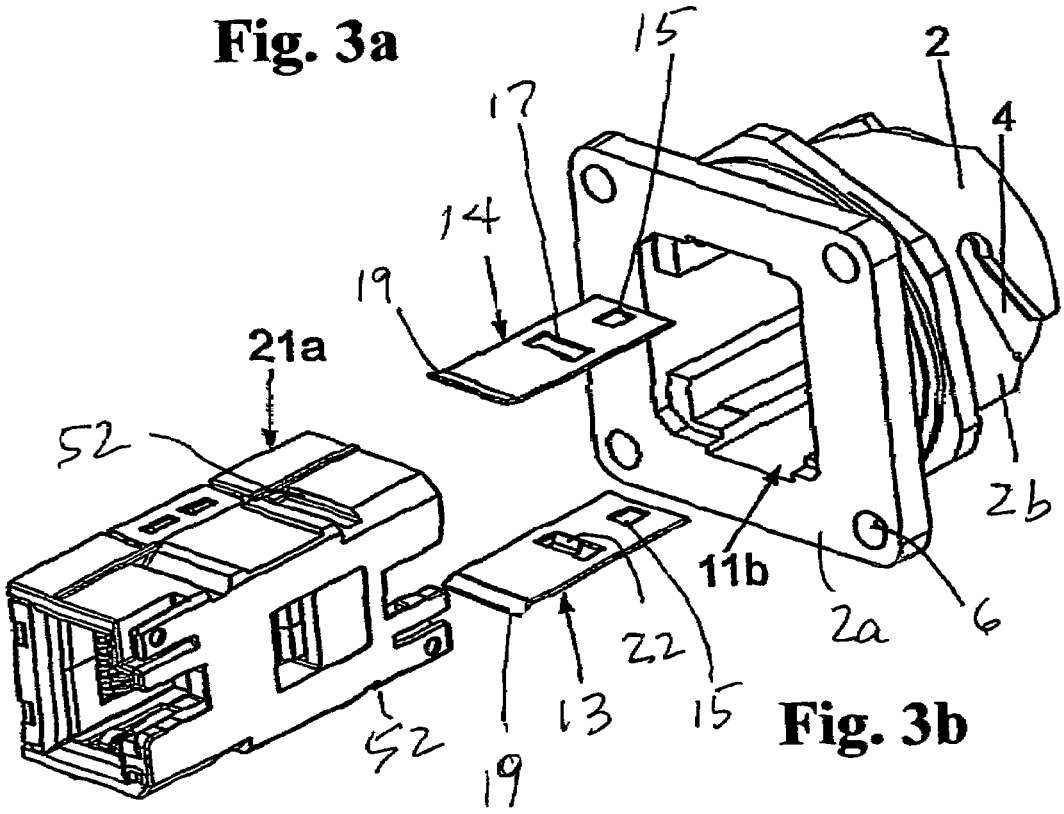
Figures 4, 15:
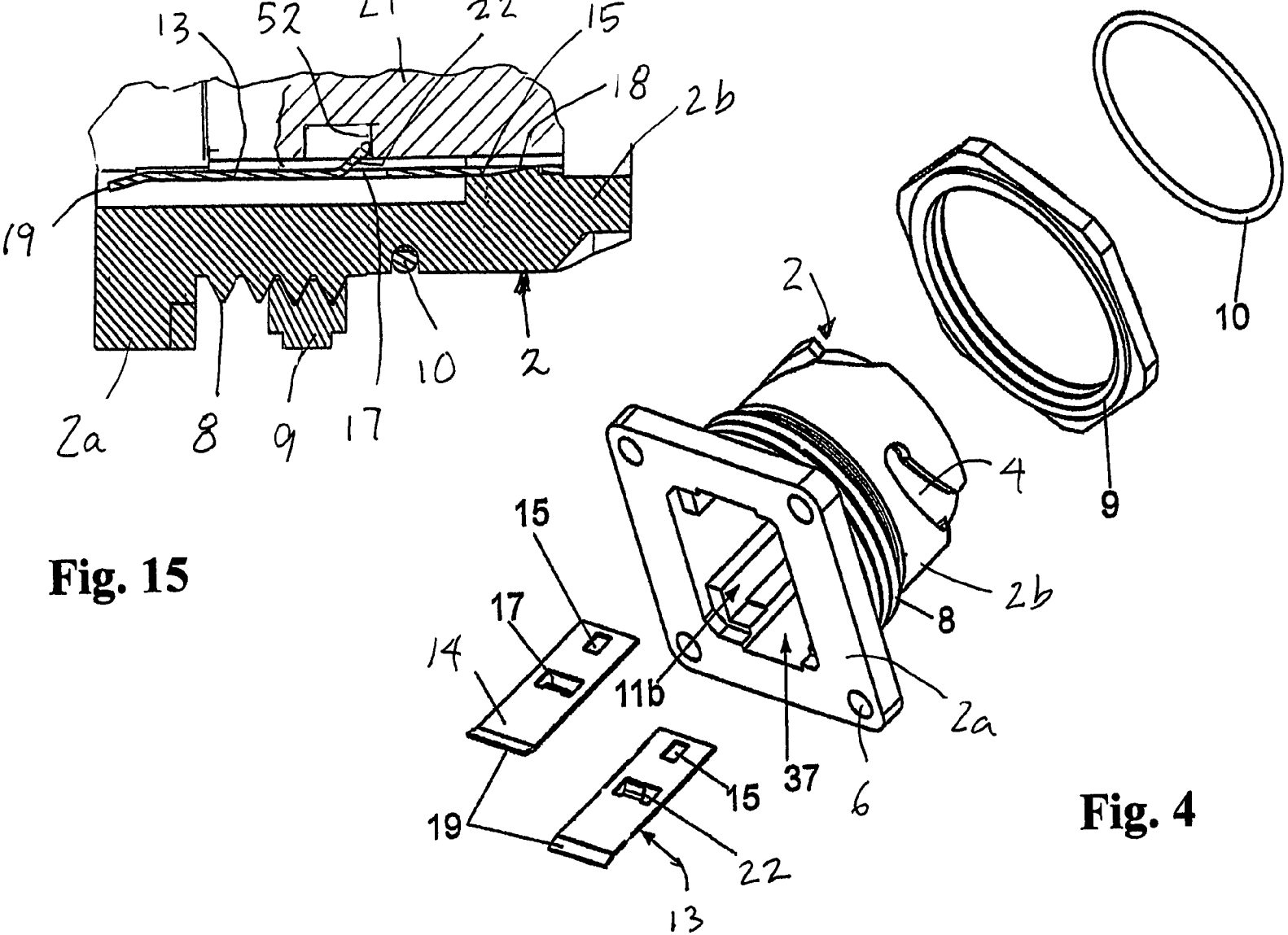
FIG. 4 is an exploded view of the adapter body of FIG. 3.
FIG. 15 is a detailed sectional view illustrating the locking plate means of FIGS. 1*a* and 1*b;*

As illustrated in FIGS. 3*a* and 3*b*, an adapter body 2 may be provided for mounting a smaller given telecommunications plug 21*a* within the first plug-receiving chamber 11*a* contained in the housing 1. More particularly, the adapter body 2 has a first end 2*a* provided with a rectangular cross-sectional configuration, and a second end 2*b* having a circular cross-sectional configuration for insertion within the outer sleeve member 25 (FIGS. 1*a* and 1*b*) provided at the first end of the housing 1. More particularly, the second end 2*b* of the adapter body 2 is fastened to the outer sleeve 25 by means of a bayonet connection including fastening pins 3 arranged on the inner surface of the sleeve 25 that cooperate with corresponding bayonet slots 4 contained in the outer surface of the second end portion 2*b* of the adapter body. The adapter body 2 contains a second through bore 54 (FIG. 5*b*) that terminates in the second plug-receiving chamber 11*b*. As shown in FIG. 3*b*, two parallel spaced locking plates 13 and 14 serve to lock a plug 21*a* of the RJ45 type within the second chamber 11*b*. The locking plates 13 and 14 contain at first ends openings 15 that receive corresponding projections provided on the inner surface of the adapter body 2. At the other ends, the locking plates are provided with projections 22 that are punched out from the opening 17 to define stop surfaces that engage the retaining surfaces 52 on the outer surface of the plug 21*a*. As best shown in FIGS. 4 and 15, the free extremities of the locking plates are provided with angularly bent extremities 19 that facilitate insertion of the plug 21 within the second chamber 11*b*.

Figure 5A:
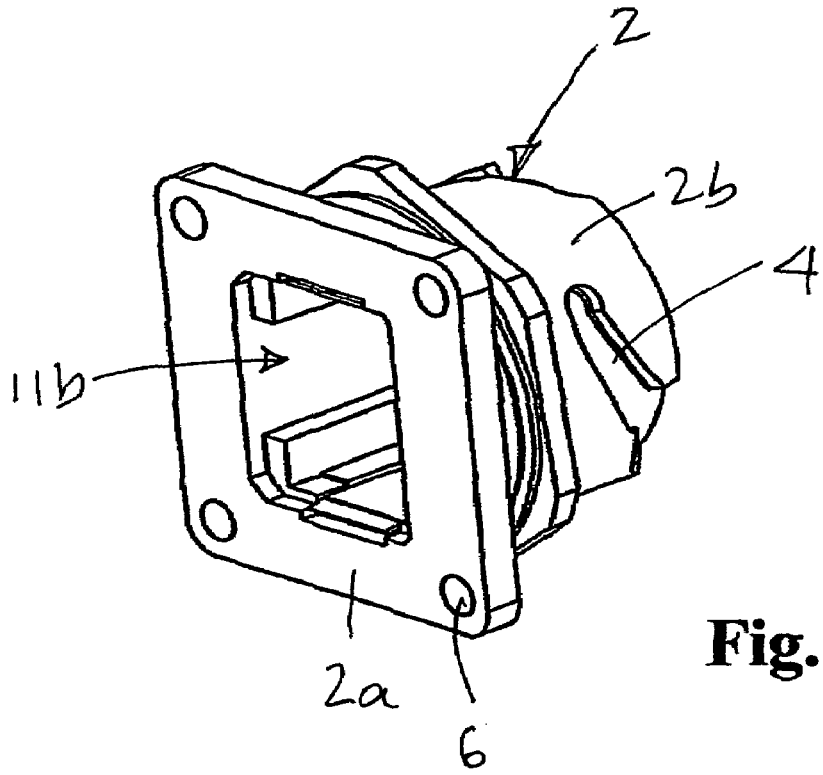
FIGS. 5*a* and 5*b* are perspective and longitudinal views, respectively, of the adapter body and locking plate means of FIGS. 3*a* and 3*b;*
Figure 5B:
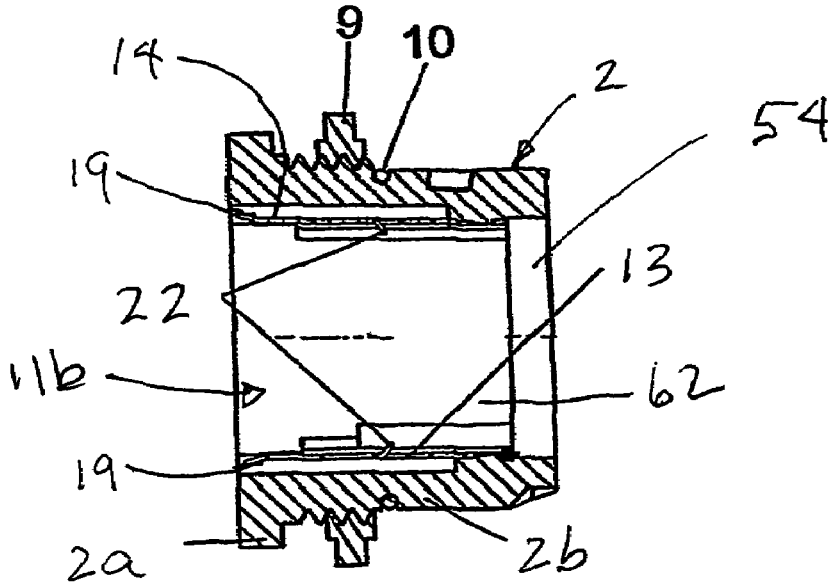
Figure 17A:
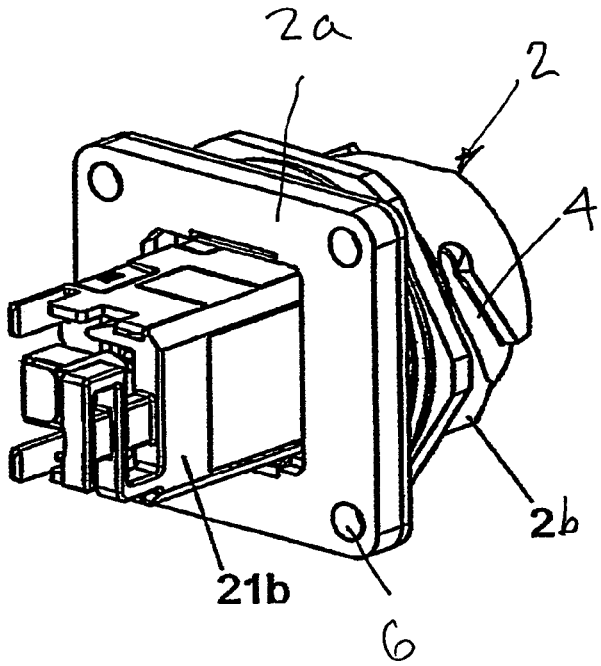
FIGS. 17*a* and 17*b* are perspective and exploded views, respectively, of the adapter body apparatus of FIG. 4 receiving a first plug embodiment.
Figure 17B:
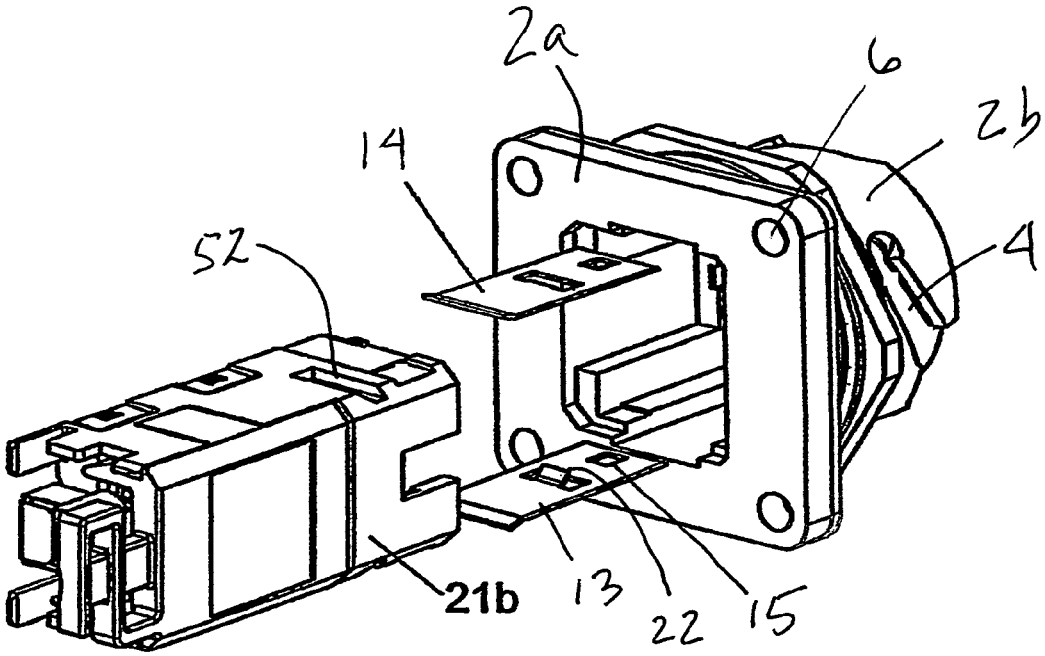
Figure 18A:
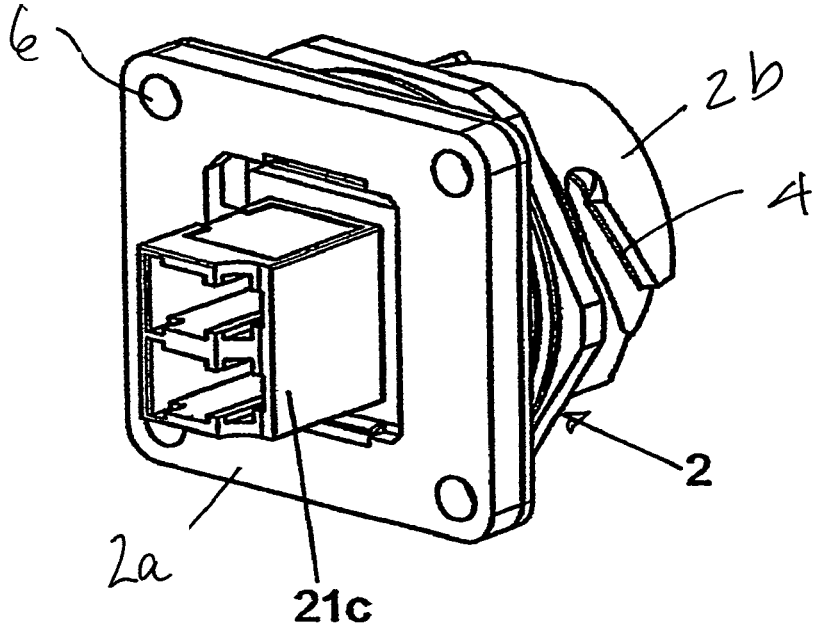
FIGS. 18*a* and 18*b* and 19*a* and 19*b* illustrate other plug and adapter frame embodiments for connecting a plug within the adapter body.
Figure 18B:
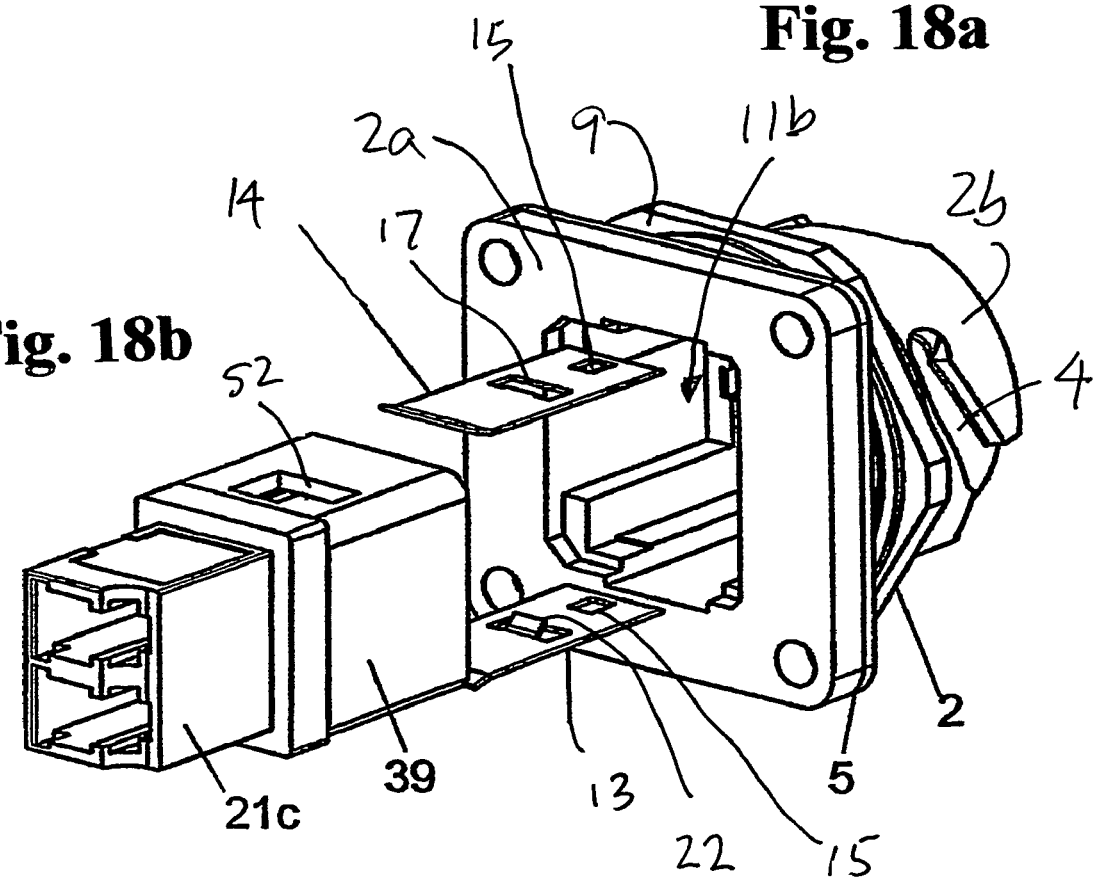
Figure 19A:
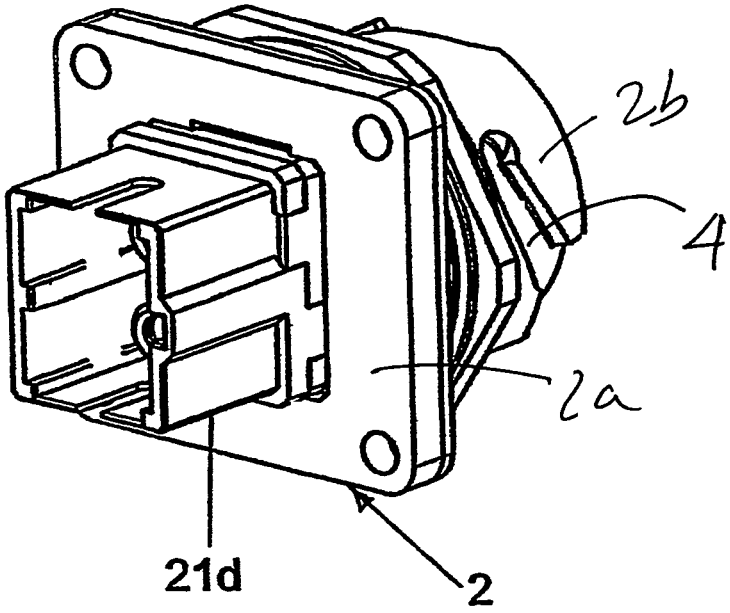
Figure 19B:
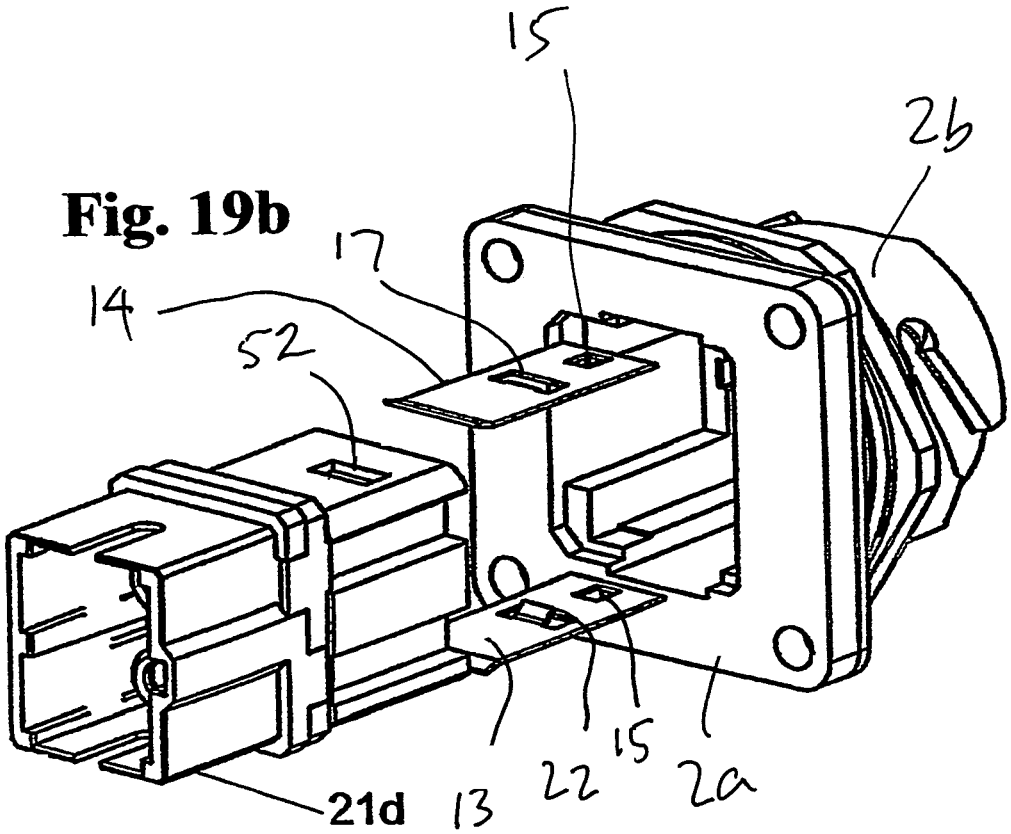

The outer surface of the adapter body portion 2*b* is provided with screw threads 8 (FIG. 15) that receive a nut 9, thereby to clamp the adapter body 2 within an opening contained in a fixed support. Furthermore, the rectangular portion of the adapter body may be secured to the fixed support by screw means extending through openings 6 contained at the corners of the flange portion 2*a* of the adapter body. In the embodiment of FIGS. 4 and 15, the locking plates are retained within the opening 11*b* of the adapter body 2 by the cooperation between projections 18 that extend into corresponding openings 15 contained in the locking plates. In the modification of FIGS. 5*a* and 5*b*, the locking plates are carried by a common support 62 that is inserted within the through bore 54 of the adapter body 2. The locking plates are supported within corresponding recesses 37 provided in the walls of the through bore of the adaptor body 2, as shown in FIGS. 4 and 16*c*. In the embodiment of FIG. 16*e*, the locking plates 13 and 14 are vertically arranged, while in the embodiment of FIG. 17, the locking plates are horizontally arranged. Furthermore, as shown in FIGS. 18*a* and 18*b*, a frame 39 may be provided for supporting a plug 21*c* within the second chamber 11*b*, the sidewalls of the frame 39 containing the stop surfaces 52 that are engaged by the projections 22 on the locking plates 13 and 14.

Figure 6A:
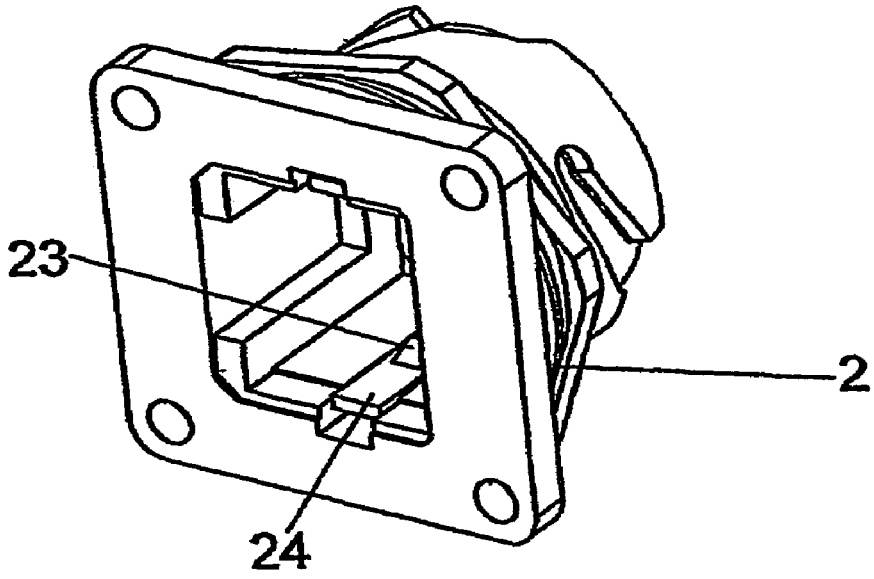
FIGS. 6*a* and 6*b* are perspective and longitudinal sectional views, respectively, of a second embodiment of the adapter body arrangement of FIGS. 3*a* and 3*b;*
Figure 6B:
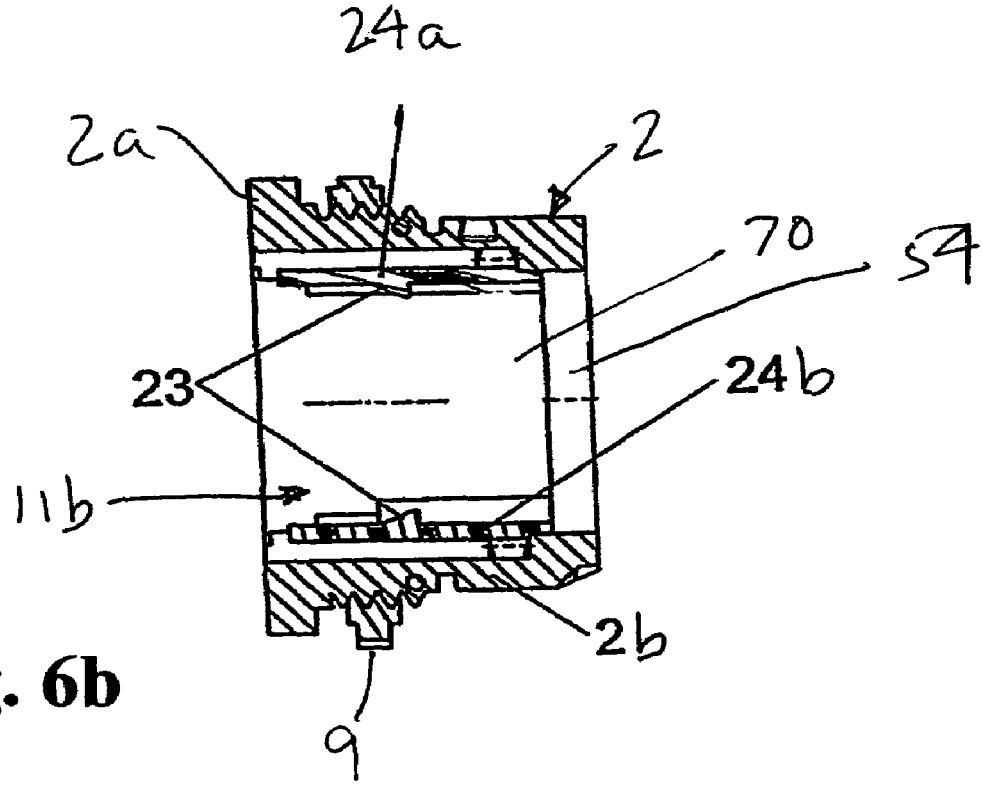
Figure 7A:
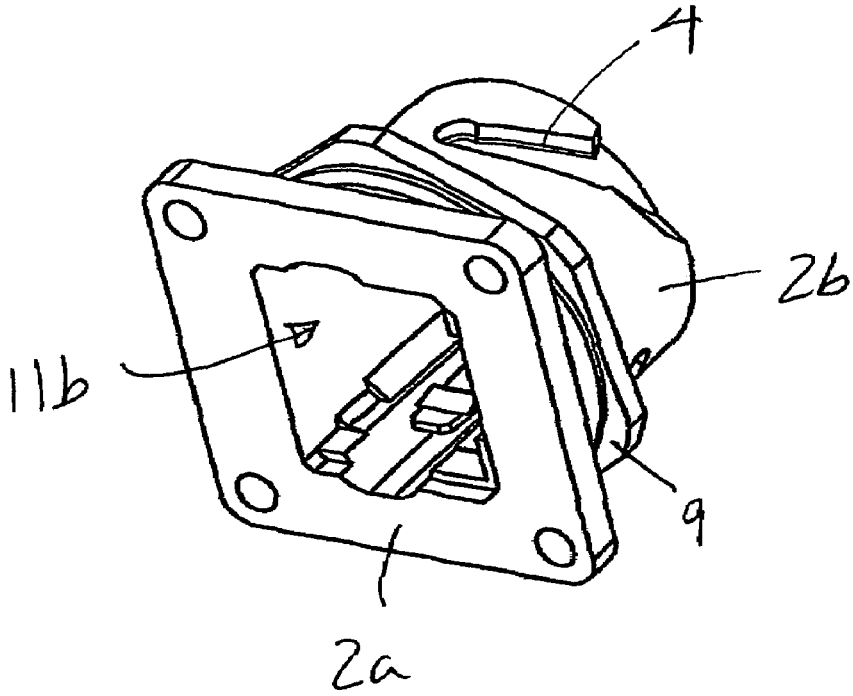
FIGS. 7*a* and 7*b* are perspective and longitudinal sectional views, respectively, of a third embodiment of the adapter body arrangement of FIGS. 3*a* and 3*b;*
Figure 7B:
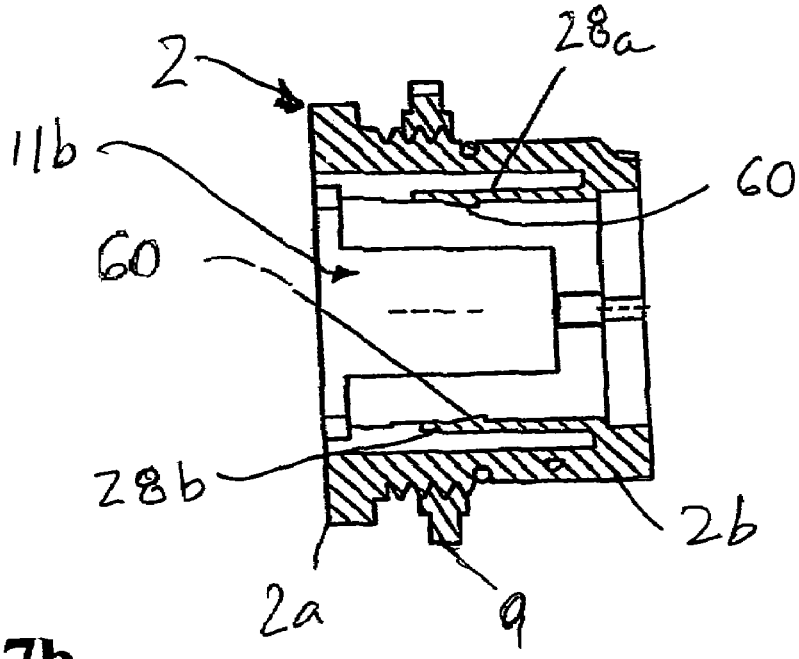
Figure 8A:
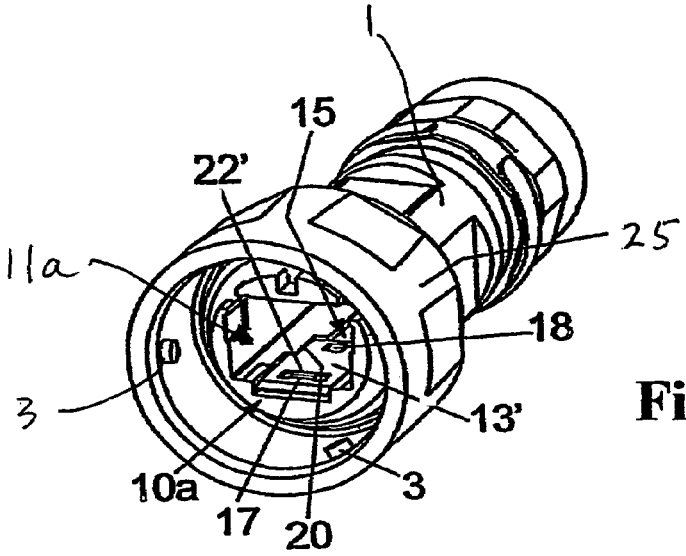
FIGS. 8*a*-8*e* are perspective and end views of the fitting of FIG. 1*a*, with certain parts removed.
Figure 8B:
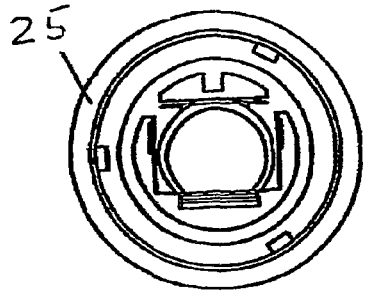
Figure 8D:
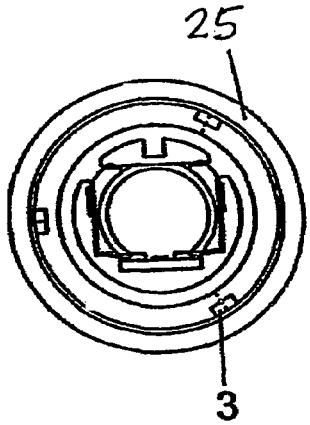
Figure 8C:
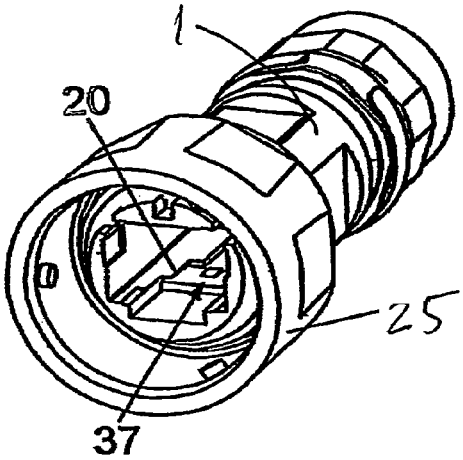
Figure 8E:
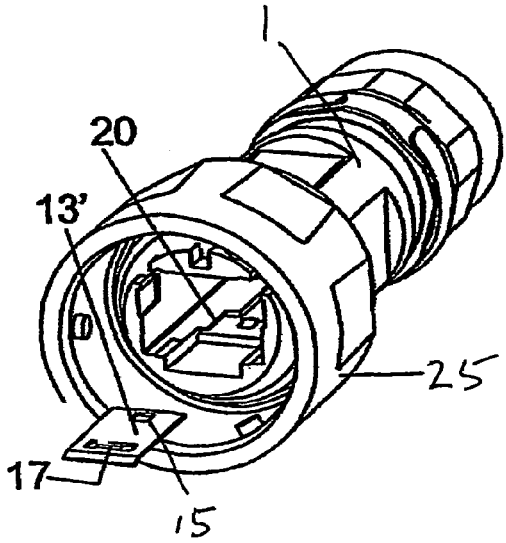

In the embodiment of FIGS. 6*a* and 6*b*, the cantilevered locking plates 24*a* and 24*b* are formed of synthetic plastic material, and are supported at their common ends by a sleeve member 70 that is inserted within the through bore 54 of the adapter body 2. In the embodiment of FIGS. 7*a* and 7*b*, the metal locking plates 28*a* and 28*b* are integral with the metal adapter body 2.

While in accordance with the provisions of the Patent Statutes, we have illustrated and described the best form and embodiments of the invention now known to us, it is apparent that changes may be made without deviating from the inventive concepts set forth above.

What is claimed is:

1. A connector assembly for connecting with a cable fitting a telecommunications plug having a cable, comprising:

(a) an elongated plug housing (1) containing a first longitudinal through bore (50) for receiving the cable (C) of a telecommunications plug (21; 34), said plug housing having first and second ends;

(b) means defining at least one first plug-receiving chamber (11*a*; 11*b*) in communication with said first through bore adjacent said plug housing first end; and (c) locking means (12) for locking the telecommunications plug within said plug-receiving chamber, including;

(1) at least one generally rectangular locking plate (13'; 13, 14; 24; 28) arranged at least partially within said chamber and extending parallel with said first through bore, said locking plate having first and second end portions;

(2) first connecting means connecting said locking plate first end portion with said housing; and (3) second connecting means connecting said locking plate second end with the telecommunications plug, said second connecting means including a locking projection (22; 23; 60) carried by said locking plate for engagement with a corresponding stop surface (52) associated with the plug when the plug is fully inserted within said chamber.

2. A connector assembly as defined in claim 1, wherein said locking plate is resilient.

3. A connector assembly as defined in claim 2, wherein said locking plate is formed of metal.

4. A connector assembly as defined in claim 3, wherein said plug housing is formed of metal, and further wherein said plate first end portion is integral with said housing.

5. A connector assembly as defined in claim 2, wherein said locking plate is formed from a synthetic plastic material.

6. A connector assembly as defined in claim 5, wherein said plug housing is formed of metal; and further wherein said first connecting means includes include synthetic plastic sleeve means (70) supporting said locking plate within said chamber.

7. A connector assembly as defined in claim 2, wherein said locking plate first connecting means comprises a mounting projection (18) arranged in fixed relation within said plug-receiving chamber, said mounting projection extending within a mounting opening (15) contained in said locking plate, thereby to prevent longitudinal displacement of said plate relative to said chamber.

8. A connector assembly as defined in claim 7, wherein said locking plate first end portion extends within a mounting slot (20; 37) defined in a wall portion of said plug-receiving chamber.

9. A connector assembly as define in claim 8, wherein said slot (20) includes undercut side walls.

10. A connector assembly as defined in claim 7, wherein said locking plate second end portion terminates in an end extremity (19) that is inclined at an acute angle relative to the plane containing said locking plate, thereby to facilitate entry of the telecommunication plug into said chamber.

11. A connector assembly as defined in claim 2, wherein said locking projection (22, 22') is formed from said locking plate by punching and bending.

12. A connector assembly as defined in claim 2, and further including:

(d) adapter means for mounting the telecommunications plug in said first plug-receiving chamber, said adapter means comprising:

(1) an adapter body (2) containing a second through bore (54), said adapter body having:

(a) a first end portion (2*a*) containing a second plug-receiving chamber (11*b*) in communication with said second through bore, and (b) a second end portion (2*b*) adjacent said first plug-receiving chamber; and (e) mounting means connecting said adapter body with said plug housing first end.

13. A connector assembly as defined in claim 12, wherein said mounting means includes a mounting sleeve (25) arranged for rotation concentrically about said housing first end; and further including:

(f) bayonet fastening means (3, 4) fastening said adapter body second end portion to said mounting sleeve.

14. A connector assembly as defined in claim 12, wherein said locking means include a pair of said locking plates (13, 14) arranged in parallel spaced relation for locking to said adapter body the opposite sides of a telecommunication plug inserted within said second plug-receiving chamber.

15. A connector assembly as defined in claim 12, and further including adapter frame means (39) for mounting said telecommunication plug within said second plug-receiving opening, said adapter frame means including a rectangular frame having a pair of parallel side walls extending longitudinally of said second through bore, said side walls each containing a recess defining said stop surface; and further wherein said locking means includes a pair of parallel locking plates (13, 14) extending adjacent said adapter frame side walls, said locking plates having projections (22) in locking engagement with said stop surfaces, respectively.

16. A connector assembly as defined in claim 2, and further including adapter frame means (35; 36; 37; 38) for mounting a telecommunications plug (34) within said first plug-receiving chamber, said locking means including at least one locking plate (13') operable to lock said adapter frame means within said first plug-receiving chamber.

17. A connector assembly as defined in claim 2, and further including tubular cable support means (40) connected with said housing plug second end for receiving and supporting the cable (C) leading to the telecommunication plug.

18. A connector assembly for connecting with a cable fitting a telecommunications plug attached to a cable, comprising:

(a) an elongated plug-supporting housing (1) containing a first longitudinal through bore (50) for receiving the cable, said housing having first and second ends;

(b) means defining a first plug-receiving chamber (11*a*) in communication with said first through bore adjacent a first end of said housing;

(c) adapter means for mounting the telecommunication plug in said first plug-receiving chamber, said adapter means comprising:

(1) an adapter body (2) containing a second through bore (54), said adapter body having;

(a) a first end portion (2*a*) containing a second plug-receiving chamber (11*b*) in communication with said second through bore, and (b) a second end portion (2*b*);

(d) mounting means mounting said adapter body on said plug housing first end with said second through bore in communication with said first through bore, said mounting means including a mounting sleeve (25) arranged concentrically about said plug housing first end;

(e) fastening means (3, 4) fastening said adapter body second end portion within said mounting sleeve; and (f) locking means (12) for locking a telecommunications plug (21; 34) within said second plug-receiving chamber, including;

(1) a pair of parallel spaced generally rectangular locking plates (13, 14; 24; 28) arranged at least partially within said chamber and extending parallel with said second through bore, said locking plates having first and second end portions arranged to receive therebetween the telecommunications plug;

(2) first connecting means connecting said locking plate first end portions with said adapter body; and (3) second connecting means connecting said locking plate second end portions with the adjacent surfaces of said telecommunications plug, said second connecting means including a locking projection (22; 23; 60) carried by said locking plate for engagement with a corresponding stop surface (52) associated with the telecommunications plug when the plug is fully inserted within said second plug-receiving chamber.

19. A connector assembly for connecting with a cable fitting a telecommunications plug attached to a cable, comprising:

(a) an elongated plug housing (1) containing a first longitudinal through bore (50) for receiving the cable, said housing having first and second ends;

(b) means defining a first plug-receiving chamber (11*a*) in communication with said first through bore adjacent a first end of said housing;

(c) adapter frame means for mounting the telecommunications plug in said first plug-receiving chamber, said adapter frame means including a generally rectangular open-ended hollow frame (35; 36; 37; 38) for receiving said telecommunications plug, said frame having at least one side wall extending longitudinally of said plug housing; and (g) locking means (12) for locking said adapter frame within said first plug-receiving chamber, including;

(1) at least one locking plate (13') arranged at least partially within said first chamber and extending parallel with said first through bore, said locking plates having first and second end portions;

(2) first connecting means connecting said locking plate first end portion with said second plug-receiving chamber; and (3) second connecting means connecting said locking plate second end with said adapter frame, said second connecting means including a locking projection (22) carried by said plate for engagement with a corresponding stop surface (52) associated with the adapter frame when the adapter frame is fully inserted within said first plug-receiving chamber.

* * * * *